US005094053A

United States Patent [19]

Militzer

[11] Patent Number: 5,094,053

[45] Date of Patent: Mar. 10, 1992

[54] DIVIDING WALL, PARTICULARLY FOR EXPOSITION HALLS

[75] Inventor: Gottfried Militzer, Sonnenbuehl, Fed. Rep. of Germany

[73] Assignee: MBA-Design & Display Produkt GmbH, Reutlingen, Fed. Rep. of Germany

[21] Appl. No.: 585,120

[22] PCT Filed: Jan. 22, 1990

[86] PCT No.: PCT/EP90/00121

§ 371 Date: Oct. 10, 1990

§ 102(e) Date: Oct. 10, 1990

[87] PCT Pub. No.: WO90/08864

PCT Pub. Date: Aug. 9, 1990

[30] Foreign Application Priority Data

Jan. 27, 1989 [DE] Fed. Rep. of Germany ..... 3902385

[51] Int. Cl.[5] ..... E04B 1/82

[52] U.S. Cl. ..... 52/238.1; 52/239; 52/562; 52/582; 52/221

[58] Field of Search ..... 52/239, 242, 582, 584, 52/562, 595, 238.1

[56] References Cited

U.S. PATENT DOCUMENTS

| | | | |
|---|---|---|---|
| 2,853,751 | 9/1958 | Schlueter | 52/584 |
| 3,357,146 | 12/1967 | Gartrell | 52/582 |
| 3,529,389 | 9/1970 | Wilkins | 52/221 |
| 4,185,430 | 1/1980 | Gartung | 52/582 |
| 4,833,848 | 5/1989 | Guerin | 52/238.1 |
| 4,841,707 | 6/1989 | Novoa | 52/562 |

*Primary Examiner*—David A. Scherbel
*Assistant Examiner*—Wynn Wood
*Attorney, Agent, or Firm*—Michael J. Striker

[57] ABSTRACT

The dividing wall is assembled from a plurality of inherently rigid wall elements (10). A wall element of the wall was a frame composed of vertical frame sides (11, 12) and horizontal frame sides (13, 14), an inner plate (22) suitable for anchoring nails or screws and cover plates (20, 21) which can have a thin construction, a stiffening honeycomb filling (23) being provided between the cover plates (20, 21). The vertical frame sides (11, 12) are provided with a conical external groove (15) or an external spring pin (16) which fits into the latter, so that adjoining wall elements can be put together so as to be self-centering, wherein the reciprocal connection is effected by inserting coupling pegs of one wall element in catch openings of the other wall element. The dividing wall thus is made of lightweight individual wall elements which can be assembled quickly.

9 Claims, 6 Drawing Sheets

DIVIDING WALL, PARTICULARLY FOR EXPOSITION HALLS

BACKGROUND OF THE INVENTION

The invention is directed to a dividing wall, particularly for exposition halls, which can be assembled from a plurality of rectangular, inherently rigid wall elements which are detachably connectable with one another by coupling members, and a frame which is formed by different section rails and is filled by at least one panel, the frame sides being connected with one another via separate corner pieces, wherein the panels of the individual wall elements are constructed as lightweight construction elements which are anchored to the frame and comprise two cover panels or plates.

A dividing wall system of the type mentioned above, which comprises self-supporting or structural supporting wall elements, has already been suggested (DE-A-34 44 521). Panels are also known from EP-A-247 955; these panels comprise two cover plates arranged at a distance from one another and coupled with one another partly by corner pieces and partly by frame sides, but their stability is limited by the frame construction.

SUMMARY OF THE INVENTION

The invention has the object of constructing a dividing wall of the type named in the beginning in such a way that its wall elements have a smaller weight by volume than previously and have great stability and can be assembled faster to form a dividing wall and can also be more quickly detached from one another again.

The proposed object is met with a dividing wall of the above-mentioned type, which, according to the invention, is provided with panels constructed with at least one inner plate which is spaced from the cover plates and is suitable for anchoring holding members, such as nails or screws, and the intermediate space between the inner plate and cover plates is provided with a lightweight, but stiffening, honeycomb filling, and at least the vertical frame sides of the frame of the wall elements are provided on their outer front side with an external groove or an external spring pin which fits into the latter and has a conical cross section. The vertical frame sides have outer lateral contact faces for the edge areas of the two cover plates of the panel and at least one shoulder surface interiorly for the inner plate of the panel. The inner plate can advisably be formed from a micro-chipboard.

Very light fillings of the wall elements, in which nails or screws can nevertheless be anchored with sufficient strength against removal, can be achieved by means of the special design of the panel. The frame of the wall elements can also be constructed in turn so as to be relatively lightweight, e.g. from extrusion-molded section rail portions of light metal or a plastics material, by means of this light and rigid filling.

The vertical frame sides are integrated with the wall filling in a regular manner by means of the cover plates which rest against the vertical frame sides on the outer lateral contact faces by their edge region and are e.g. securely glued together, as well as by means of gluing the edge of the inner plate with the inside shoulder surface of the vertical frame. The external grooves and external spring pins of the vertical frame sides fit into one another with their conical cross sections so that an accurate centering of adjacent wall elements is effected. Edge stops provided on the outer front side can ensure an accurate optional, particularly very small spacing between adjacent wall elements. The external spring pin of the vertical frame sides can be constructed advantageously so as to be hollow for the purpose of economizing on weight and for running internal lines. In a dividing wall constructed according to the invention, the horizontal frame sides of the wall frame can have a gutter-shaped cross section with gutter openings in the outer front side having opposing horizontal lips. They can also be integrated in the wall filling in a regular manner as described above in connection with the vertical frame sides. The gutter-shaped cross section with the opposing horizontal lips favors the anchoring of fastening elements for optional added parts and for shoulder strips, by means of which side walls can be fastened to the individual wall elements at a desired location.

The additionally desired possibility for quickly connecting and detaching the individual wall elements of the dividing wall is achieved in that the individual wall elements are not screwed together in a time-consuming manner, but rather can be connected with one another simply by means of hanging. For this purpose, the wall elements can advisably comprise, at the top or bottom of their frame, laterally projecting brackets with at least one spherical coupling peg which is aligned so as to be parallel to the edge, which brackets can be inserted into the open end of a horizontal frame side of an adjoining wall element provided with at least one catch opening for the coupling peg.

BRIEF DESCRIPTION OF THE DRAWINGS

Further features of the invention, which also comprises auxiliary mounting means for and removing the wall elements, are described in the following description in connection with the drawing which shows a preferred embodiment example of a wall element and auxiliary mounting means in which the figures are as follows.

DETAILED DESCRIPTION OF THE INVENTION

Figure 1:
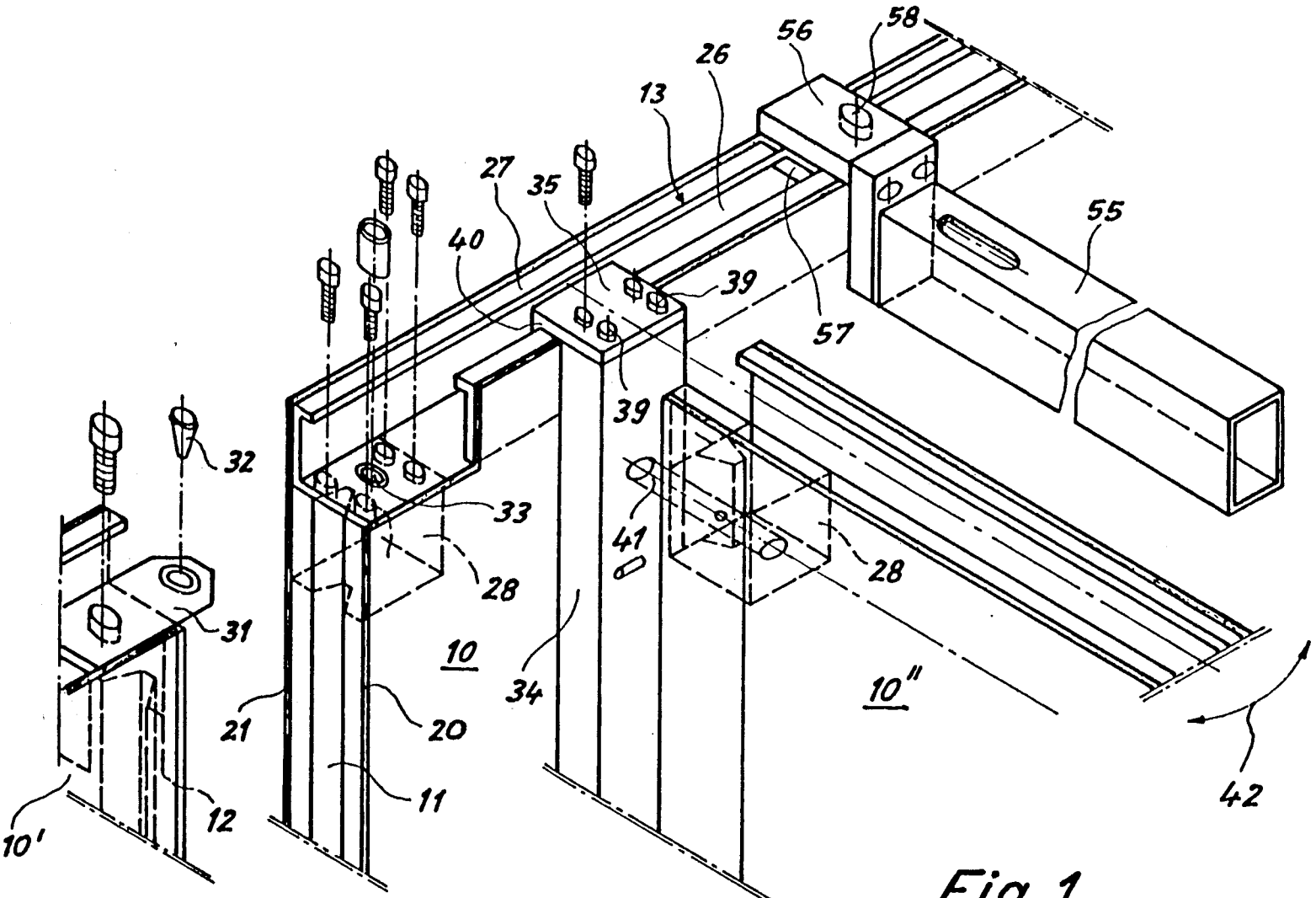
FIG. 1 a perspective view of the upper corner of a wall element and the corner of an adjoining wall element with frame parts, partially in section, and with individual parts in an exploded view.
Figure 2:
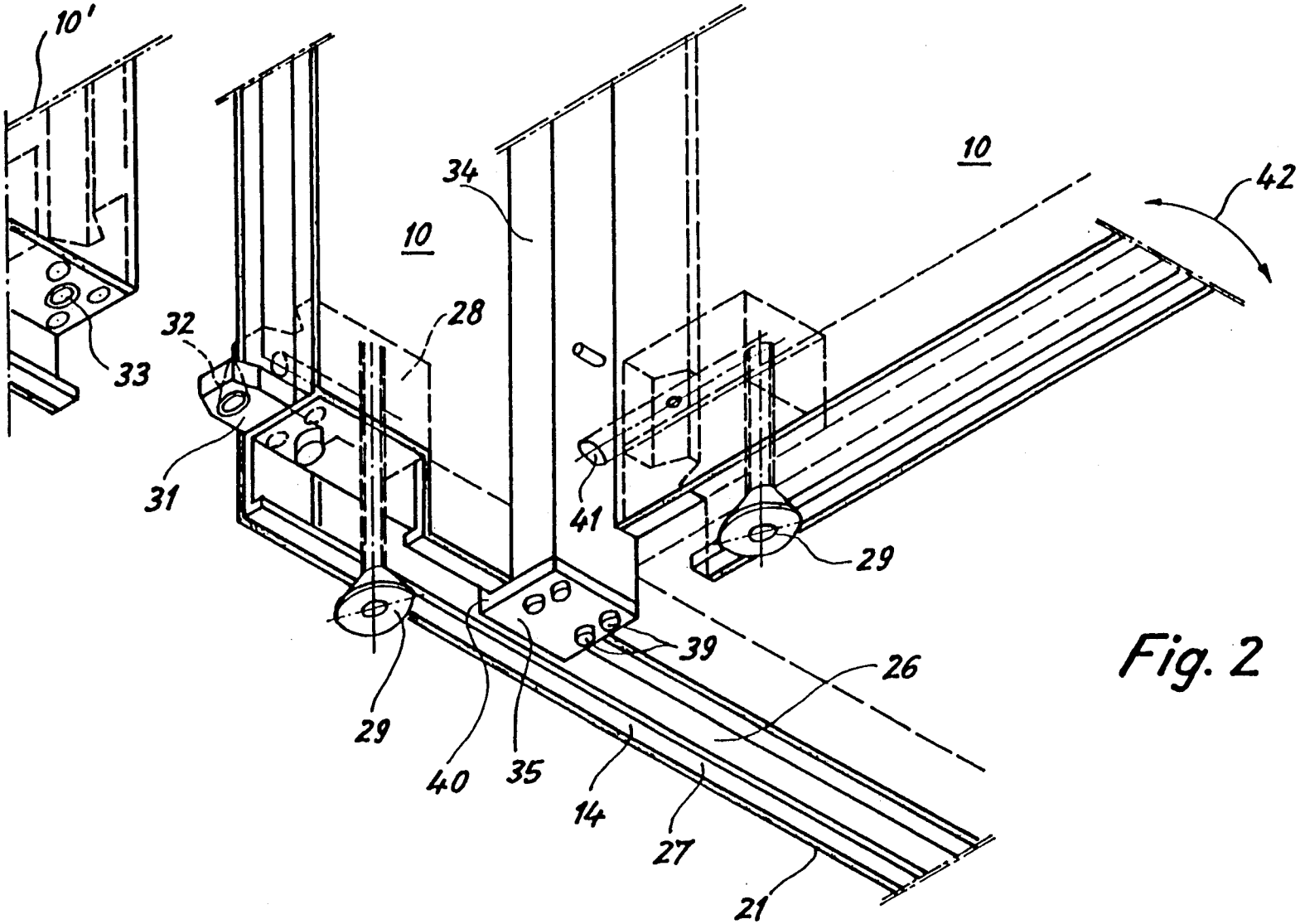
FIG. 2 a perspective view of the lower corner of a wall element and the corner of an adjoining wall element with frame parts partially in section.
Figure 3:
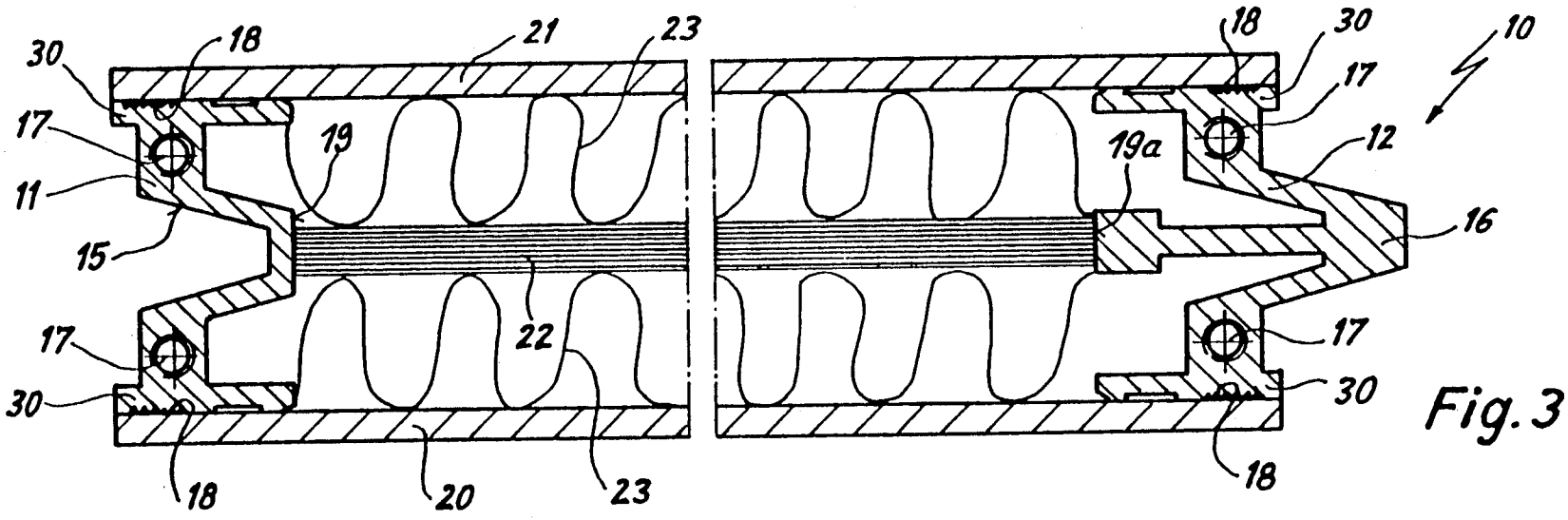
FIGS. 3 and 4 a horizontal cross section through two wall elements which differ from one another in that the vertical frame sides are arranged differently.
Figure 4:
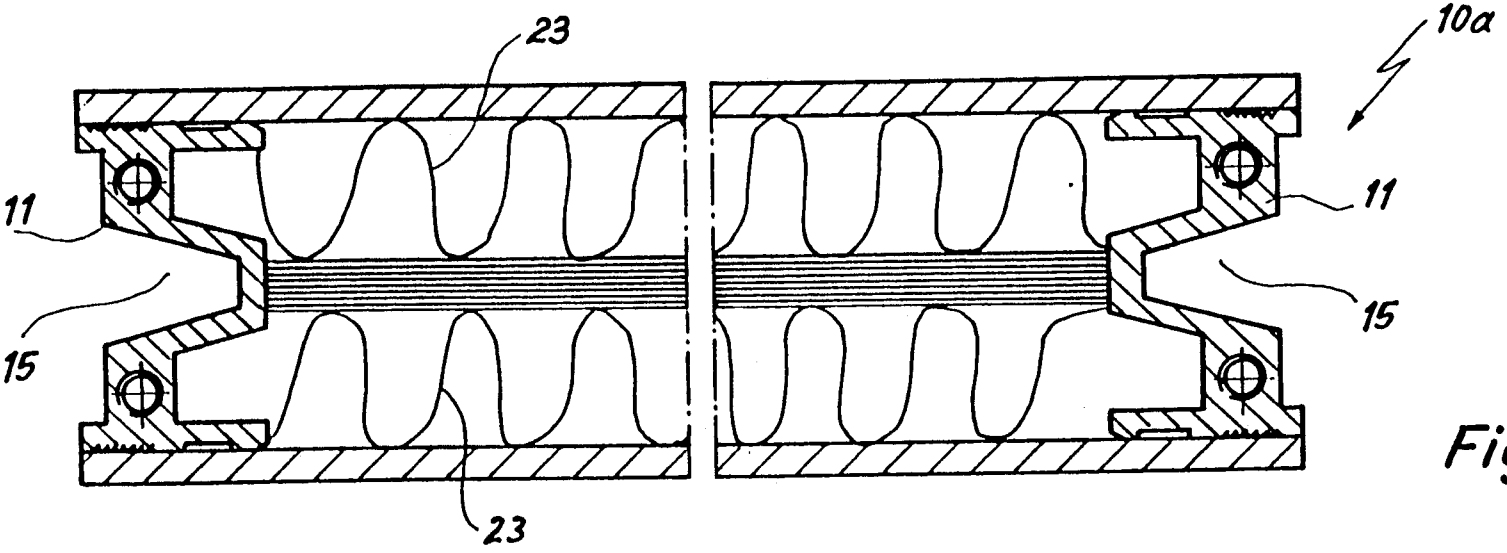

FIGS. 1 and 2 show an upper corner and a lower corner of a wall element 10 and the corresponding corner of an adjoining wall element 10'. The wall elements 10 comprise a frame. The frame comprises metal section rail portions having different cross sections, namely two vertical frame sides 11 and 12 and two horizontal frame sides 13 and 14. The cross sections of the vertical frame sides 11 and 12 can be seen from FIGS. 3 and 4, which show a horizontal cross section through two wall elements 10 and 10*a*. The vertical frame side 11 comprises an external groove 15 which widens outward in a conical manner, a correspondingly conical external spring pin of the other vertical frame side 12 fitting into the latter. The two vertical frame sides 11 and 12 are provided, at least in their end area, with threaded bore holes 17 extending in their longitudinal direction and have roughened or jagged outer shoulder surface 18 as well as a contact face 19 and 19*a* on the inside for parts of a panel of the wall element 10 or 10*a*, which panel forms the frame filling. The edge regions of two cover plates 20 and 21 of the panel rest against the outer lateral contact faces 18 and are securely connected with the vertical frame side 11 and 12 by means of gluing. The edges of an inner plate 22 rest against the inner shoulder surface 19 of the vertical frame side 11 and against the inner contact face 19*a* of the vertical frame side 12 and are securely glued together with the vertical frame side. The inner plate 22 is formed by a micro-chipboard in which nails or screws driven into the frame filling can be anchored. The intermediate spaces between the outer cover plates 20 and 21 and the more stable inner plate 22 are provided with a light, stiffening honeycomb filling 23. The wall element 10*a* shown in FIG. 4 differs from the wall element 10 shown in FIG. 3 only in that it comprises, at both sides, vertical frame sides 11 with a conical external groove 15. Such wall elements can serve e.g. as terminating or closing wall elements, wherein the external groove 15 at the outer edge of the wall can be closed by means of a covering strip, not shown. The two vertical frame sides 11 and 12 have flange-like edge stops 30 on their outer front side for the frame sides of adjacent wall elements 10'.

Figure 5:
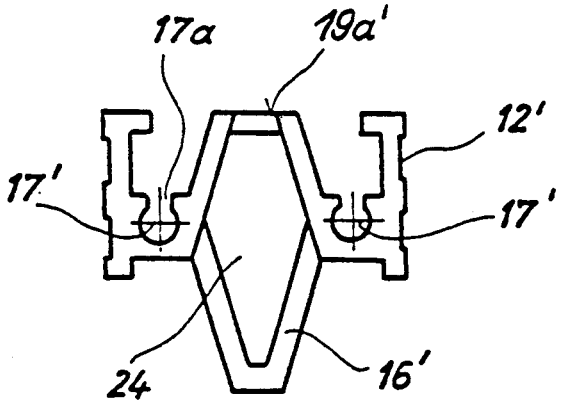
FIG. 5 a cross section through a modified embodiment form of a vertical frame side with external spring pin.
Figure 6:
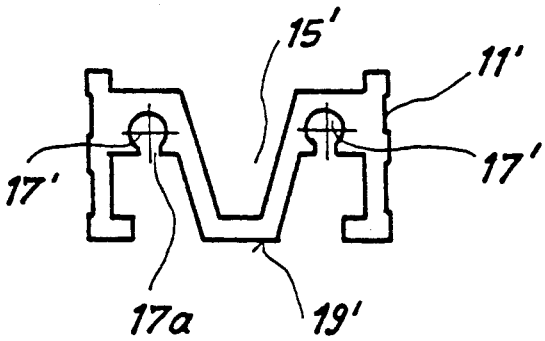
FIG. 6 a cross section through a modified embodiment form of a vertical frame side with external groove.

Modified vertical frame sides 11' and 12' are shown in FIGS. 5 and 6. They differ from the vertical frame sides 11 and 12 according to FIG. 3 in that the external spring pin 16 in the vertical frame side 12' encloses a hollow space 24 in which e.g. electrical lines can be inserted. Moreover, inner through-grooves 17' having a circular cross section and a groove opening 17*a* which is reduced in diameter and in which screws, particularly screws with self-tapping threads, can be anchored are provided instead of the threaded bore holes 17.

Figure 7:
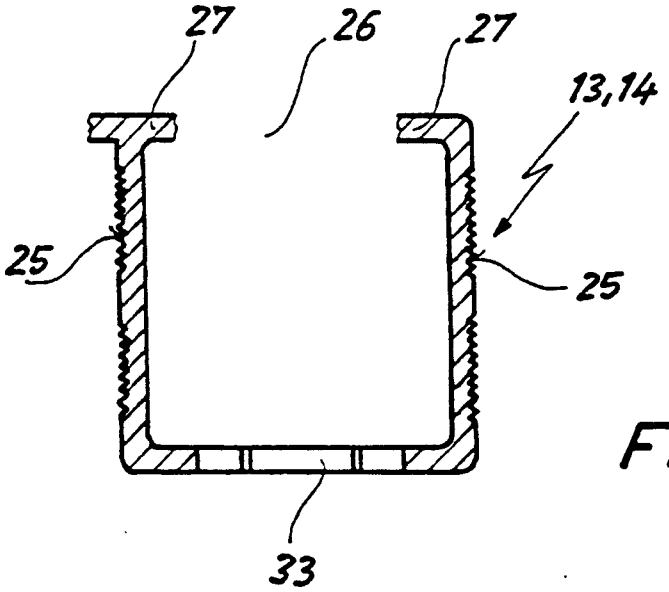
FIG. 7 a cross section through a horizontal frame side of a wall element.

Shoulder surfaces 19' and 19'*a* correspond to shoulder surfaces 19 and 19*a* in the embodiment of FIGS. 1 and 2. The cross section of a horizontal frame side 13 or 14 can be seen from FIG. 7. It likewise has lateral contact faces 25 for the edge regions of the cover plates 20 and 21 and is constructed in a gutter-shaped manner, and the gutter opening 26 situated on the outer front side horizontal frame sides is provided with opposing horizontal lips 27, as can be seen from FIGS. 1 and 2.

The vertical frame sides 11, 12 and the horizontal frame sides 13, 14 of every wall element 10 are connected with one another by corner pieces 28 which are produced from plastic and indicated in FIGS. 1 and 2; the corner pieces 28 contact the frame side ends on the inside so as to fit and are provided with a plurality of smooth bore holes and threaded bore holes which are provided for fastening screws and for optional anchoring of a screw flange 29 (FIG. 2) and not designated in more detail in FIGS. 1 and 2 for the sake of clarity.

The connection of the wall elements, which center automatically due to the conical groove-and-spring connection and are arranged in a row, is effected by means of hanging. For this purpose, the wall elements 10 and 10', shown in FIGS. 1 and 2, are provided with brackets 31 at their upper right-hand corner and at their lower left-hand corner, which brackets 31 are inserted into the open end of a horizontal frame side 13 or 14, project laterally over the frame and carry a coupling peg 32 at their projecting part. Two coupling pegs which are arranged one after the other in the longitudinal direction of the bracket 31 can also be provided. The brackets 31 can be inserted into the open end of a horizontal frame side of an adjacent frame element by their projecting part carrying the peg 32; the coupling peg 32 can lock in the frame element in a catch opening 33 which is formed in the base of the horizontal frame side. A wall element 10, 10' which is to be connected is thus moved in the raised state against the wall element which was mounted last and the coupling peg is then lowered for installation.

Figure 8:
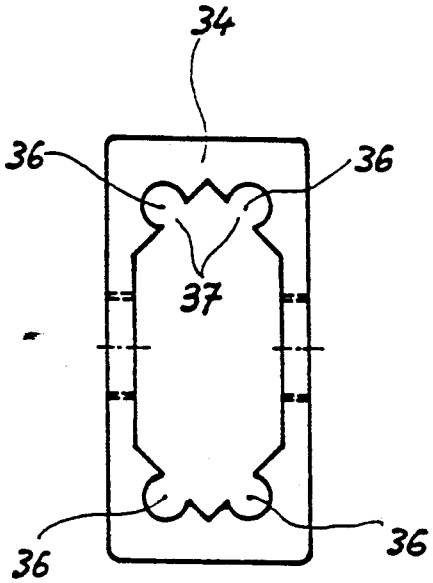
FIG. 8 a cross section through a side wall shoulder strip.
Figure 9:
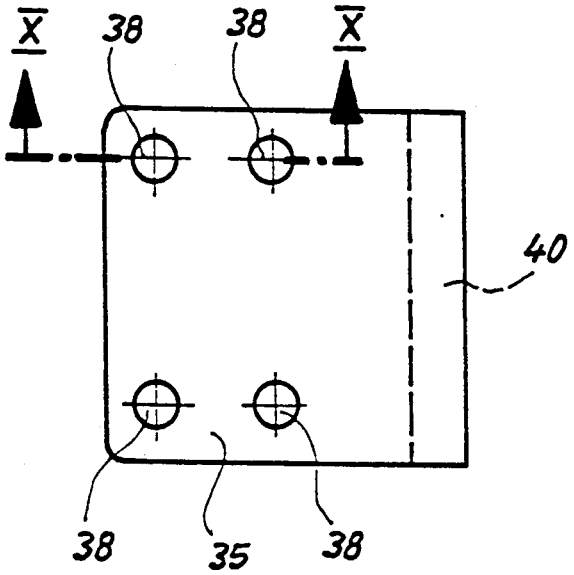
FIG. 9 a top view of an end plate for the side wall shoulder strip.
Figure 10:
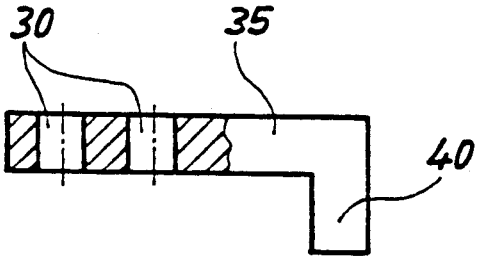
FIG. 10 a side view of the end plate, partly in section, along line X—X in FIG. 9.

Transverse wall elements 10'', one of which is shown in FIGS. 1 and 2, can be attached at a desired location at every wall element 10, 10'. For this purpose, side wall shoulder strips 34 can be attached at the wall elements so as to rest against a cover plate and can be anchored at a desired location at the upper horizontal frame side 13 and at the lower horizontal frame side 14 by means of detachable end plates 35. FIG. 8 shows the section of the side wall shoulder strip 34 which is constructed in practice as a four-sided pipe and comprises, at its inside, longitudinal grooves 36 with a circular cross section and a groove opening 37 which is reduced in diameter. Fastened, screws 39 guided through bore holes 38 in the end plates and can be seen from FIGS. 1 and 2, can be, anchored in this groove opening 37. As can be seen from FIGS. 9 and 10, the end plates 35 comprise a part which projects laterally over the side wall shoulder strip 34 and comprises an angled edge portion 40. This angled edge portion 40 engages in the gutter opening 26 of the horizontal frame sides 13 or 14. The sidewalls 10'' can then be arranged at the side wall shoulder strips 34, in a manner which is of no further interest in this context, either at a right angle to the wall element 10 by means of connection pegs 41, indicated in FIGS. 1 and 2, or also at an angle other than 90°, as is indicated in FIGS. 1 and 2 by means of a curved arrow 42, by means of articulated pins, not shown.

Figure 12:
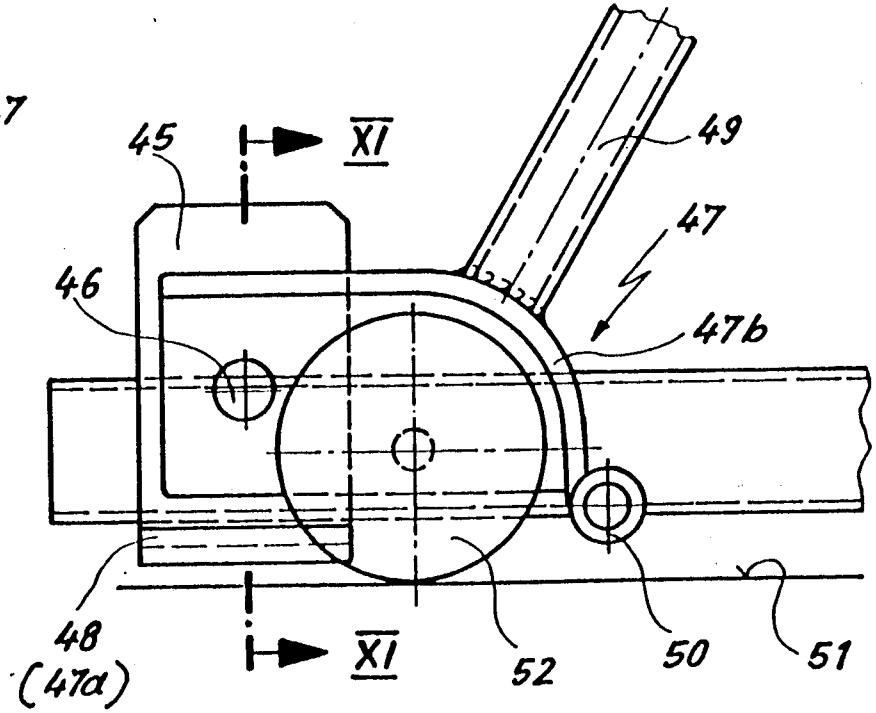
FIG. 12 a partial view of the auxiliary mounting means.
Figure 11:
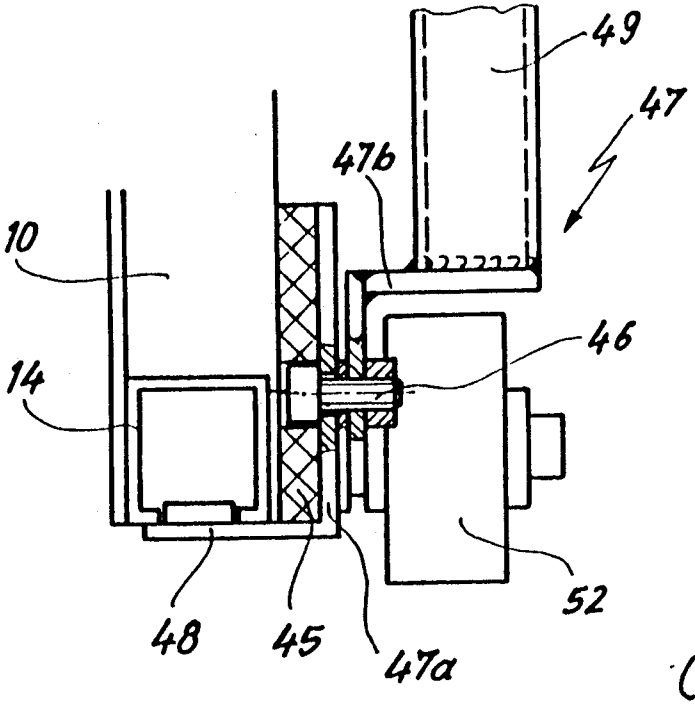
FIG. 11 a partial front view of an auxiliary mounting means fastened to a wall element, partly in section along line XI—XI in FIG. 12.

An auxiliary mounting means, which can be seen from FIGS. 11 and 12, can be used for lifting and lowering the wall elements 10, 10' during assembly or disassembly of a dividing wall. It comprises a plate-shaped support 45, a double-armed lever 47 being articulated at the latter via an axle 46. Its shorter lever arm 47*a* is constructed to form a lifting plate 48 which can be fastened to the lower horizontal frame side 14 of a wall element 10, while its longer lever arm 47*b* is provided with a long handle bar 49. A support roller 50, with which the double-armed lever 47 can be supported on a floor 51 after a short swiveling distance in the clockwise direction around the axle 46 and which can be seen from FIG. 12, is also arranged at the longer lever arm 47*b*.

The short lever arm 47*a* can also be coupled with the longer lever arm 47*b* so as to be swivelable to a limited degree in a manner which is not shown, so that the lifting plate 48 can always adjust into the horizontal position within the relatively small lifting area. The support 45 can be moved on the floor 51 by a roller 52 which is supported in an overhanging manner. It can be provided, in addition, with a second movement roller, not shown, which can be lowered and whose axis extends vertically relative to the axis of the main roller 52.

The wall elements can be constructed so as to be very lightweight with the described construction, so that the wall elements generally extend along the entire desired height of the wall. The gutter-shaped upper horizontal frame side 13 thus forms the upper closing edge of a formed dividing wall. Accordingly, all possible wall shoulder elements can be anchored, or hooks for suspension cables can be suspended, in the continuous opening 26 of the horizontal frame side 13. FIG. 1 shows, in addition to the side wall 10'', a cantilever 55 which is mounted on the horizontal frame side 13 via an angle part 56 and can also be clamped by a plate 57, which engages under opposing horizontal lips 27, and by means of a screw 58 which is supported at the angle piece 56 on the horizontal frame side 13.

It will be understood that each of the elements described above, or two or more together, may also find a useful application in other types of structures differing from the types described above.

While the invention has been illustrated and described in a dividing wall, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims.

1. Dividing wall, especially for an exposition hall, comprising a plurality of rectangular, inherently rigid, detachably connectable wall elements (10, 10'), each of said wall elements comprising:

a plurality of coupling members (31–33) for connecting said wall elements, a frame including a plurality of vertical frame sides (11, 12) and horizontal frame sides (13, 14) connected to each other by separate corner pieces (28), said fame sides being section rails and said vertical frame sides having outer front sides, at least the outer front sides of the vertical frame sides of the frame being provided with one of an external groove (15) and an external spring pin (16), said external spring pin (16) fitting another of said external grooves of another of said wall elements, said spring pin having a conical cross section, a cover plate (20, 21) attached to each side of said frame, said vertical frame sides having outer lateral contact faces (18) for an edge region of both of said cover plates (20, 21), an inner plate (22) located in said frame between said cover plate (20, 21) so as to form an intermediate space between each of said cover plates and said inner plate, said vertical frame sides having at least one interior shoulder surface (19, 19*a*) on which said inner plate (22) rests, said inner plate being made of a material suitable for anchoring holding elements, and a stiffening, honeycomb filling (23) located in said intermediate spaces between said cover plates and said inner plate.

2. Dividing wall according to claim 1, the outer front sides of the two vertical frame sides (11, 12) having edge stops (30) for the frame sides of adjacent wall elements (10').

3. Dividing wall according to claim 1, wherein the external spring pin (16') of the vertical frame said (12') is hollow.

4. Dividing wall according to claim 1, wherein at least the vertical frame sides (11', 12') are provided interiorly with a plurality of longitudinal grooves (17') having a substantially circular cross section and a groove opening (17*a*) which is reduced in diameter for the purpose of anchoring screws.

5. Dividing wall according to claim 1, wherein each of the horizontal frame sides (13, 14) of the frame have a gutter-shaped cross section with a gutter opening (26) which is situated on the outer front side of the horizontal frame side and said gutter opening has opposing horizontal lips (27), and wherein the wall elements (10, 10') are provided with at least one side wall shoulder strip (34), said side wall shoulder strip resting against one of the cover plates (20, 21) and having detachable end plates (35), each of said detachable end plates having a part which projects laterally over the shoulder strip (34) and engages in the gutter opening (26) with an angled edge portion (40).

6. Dividing wall according to claim 5, wherein the side wall shoulder strip (34) comprises a rectangular hollow section with a plurality of inner longitudinal grooves (36), each of said longitudinal grooves (36) having a substantially circular cross section and a groove opening (37), said groove opening being reduced in diameter, for fasting screws (39) for the end plates (35).

7. Dividing wall according to claim 1, wherein the corner pieces (28) serving to connect the frames sides contact the frame side ends interiorly so as to fit and are provided with a plurality of smooth bore holes and threaded bore holes for fasting screws and anchoring of a screw flange (29).

8. Dividing wall according to claim 1, wherein the wall elements (10, 10') have at the top portion and at the bottom portion of the frame, for detachable coupling, a plurality of laterally projecting brackets (31) with at least one spherical coupling peg (32), said spherical coupling peg being aligned so as to be substantially parallel to the adjacent vertical frame side, which brackets (31) can be inserted into an open end of one of the horizontal frame sides (13, 14) of an adjoining one of the wall elements (10, 10') provided with at least one catch opening (33) for the coupling peg (32).

9. Auxiliary mounting means for coupling and uncoupling adjoining wall elements of a dividing wall according to claim 1, comprising a support, a double-armed lever (47) pivotably mounted on said support, said double-armed lever having a shorter lever arm (47*a*) with a lifting plate (48) and another lever arm (47*b*) having an attached long handle bar (49) and a support roller (50) mounted on said other lever arm, said other lever arm being movable by said handle so that said support roller (50) can rest against a floor (51), and at least one main roller (52) pivotally mounted on said support, said support, said double-armed lever and said rollers being structured so that said lifting plate (48) can engage a lower horizontal frame side (15) of one of said wall elements (10).

* * * * *